United States Patent [19]

Van Kerkvoort

[11] Patent Number: 5,040,452

[45] Date of Patent: Aug. 20, 1991

[54] FLUID ACTUATORS

[76] Inventor: Maarten J. Van Kerkvoort, 8/32 Duke St., Kangaroo Point, Brisbane Queensland 4169, Australia

[21] Appl. No.: 522,130

[22] Filed: May 11, 1990

[51] Int. Cl.[5] ..... F01B 19/00

[52] U.S. Cl. ..... 92/50; 92/48; 92/61; 92/66; 92/75; 92/92; 92/118; 92/140

[58] Field of Search ..... 92/61, 66, 69 R, 50, 92/48, 75, 92, 117 R, 118, 140

[56] References Cited

U.S. PATENT DOCUMENTS

| | | | |
|---|---|---|---|
| 293,730 | 2/1884 | Goldman | 92/92 |
| 2,837,907 | 6/1958 | Halling et al. | 92/92 |
| 3,047,257 | 7/1962 | Chester | 92/92 |
| 3,379,411 | 4/1968 | Vanderjagt | 92/92 |
| 3,495,502 | 2/1970 | Bousso | 92/92 |
| 3,996,698 | 12/1976 | Rees et al. | 92/92 |
| 4,615,260 | 10/1986 | Takagi et al. | 92/92 |
| 4,667,573 | 5/1987 | Shenker | 92/48 |
| 4,784,042 | 11/1988 | Paynter | 92/48 |
| 4,819,547 | 4/1989 | Kukolj | 92/92 |

FOREIGN PATENT DOCUMENTS

| | | | |
|---|---|---|---|
| 882958 | 5/1953 | Fed. Rep. of Germany | 92/48 |
| 1315811 | 5/1973 | United Kingdom | 92/92 |
| 1336793 | 11/1973 | United Kingdom | 92/92 |

*Primary Examiner*—Edward K. Look
*Assistant Examiner*—Thomas Denion
*Attorney, Agent, or Firm*—Kimmel, Crowell & Weaver

[57] ABSTRACT

A fluid actuator including a pair of hingedly interconnected members between which is located a fluid expansible element such as a bellows which may be expanded upon application of fluid pressure to cause pivotal movement of the hingedly interconnected members. The actuator may also include a further pair of hingedly interconnected members which are themselves hinged to the first pair of members and which define with the first pair of members a space for receipt of the fluid expansible element.

15 Claims, 3 Drawing Sheets

10
11
12
13
14
15
15'
16
16'
17
18
19
20
21
22
23
24

FLUID ACTUATORS

FIELD OF THE INVENTION

This invention relates to improvements to actuators and in particular to fluid driven actuators.

1. Description of the Related Art

Many different designs and styles of actuators are presently available to suit many different applications. Fluid actuators of a number of different designs are also available and where for example a load lifting capability is required such actuators are often in the form of flexible bellows which may be expanded upon application of fluid pressure. Buch forms of actuators are presently in use as vehicle jacks and also tray lifting mechanisms on vehicles provided with tipping trays. The above devices, however, are often subject to puncturing and furthermore, pressure must continually be applied thereto to maintain the actuators in an expanded attitude. Bellows type actuators are also subject to fatigue wear and have limited application beyond the above. A further disadvantage of such actuators is that they tend to require a relatively large volume of fluid for operation.

2. Summary of the Invention

The present invention aims to provide actuating means which is responsive to the application of fluid pressure and which overcomes or alleviates one or more of the disadvantages of the above known fluid actuators. The present invention also aims to provide actuating means which may be applied to many different situations to provide movement or force to an object or device in a reliable and efficient manner. Other objects and advantages of the invention will become apparent from the following description.

With the above and other objects in view the present invention provides actuator means including a first member, a second member hingedly connected to said first member for pivotal movement about a hinge axis, and fluid expansible means arranged between said first and second members, said fluid expansible means being operable upon application of fluid pressure thereto to cause said first member to pivot relative to said second member about said hinge axis.

Preferably the actuator means includes third and fourth hingedly interconnected members, said latter members also being hingedly interconnected to said first and second members respectively and wherein the fluid expansible means is located in the area bounded by said first, second, third and fourth members.

Preferably the third and fourth members are moved substantially into longitudinal alignment when the fluid expansible means is expanded whereby to limit pivotal movement of the first and second members away from each other and also to look the first and second members in their expanded attitude. Suitably for this purpose means are provided to limit movement of the third and fourth members beyond an attitude where they are substantially aligned.

In a further form the present invention comprises a pair of actuator means of the above type arranged in a back-to-back or juxtapostioned attitude such that the second member of one actuator means also comprises the first member of the other actuator means whereby application of fluid pressure to the fluid expansible means associated with the respective actuator means will cause pivotal movement of the combined first and second members in opposite directions.

Preferably the fluid expansible means comprises a fluid expansible bag, bellows or a normally flat hose sealed at each end such that application of fluid pressure thereto causes expansion of the bag, bellows or hose.

BRIEF DESCRIPTION OF THE DRAWINGS

In order that the invention can be more readily understood and put into practical effect reference will now be made to the accompanying drawings which illustrate preferred embodiments of the invention and wherein.

DETAILED DESCRIPTION OF THE INVENTION

Figures 1, 2:
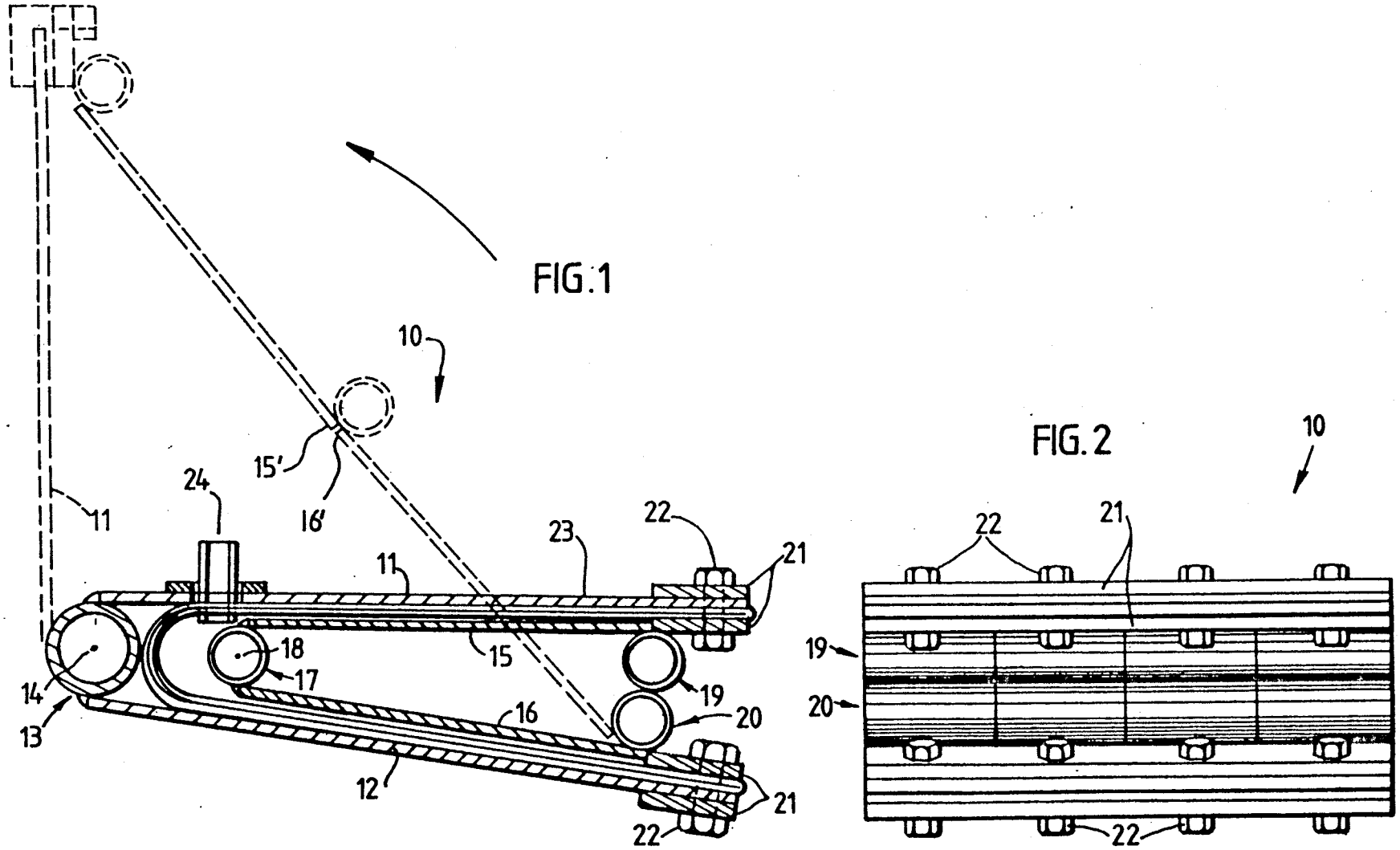
FIG. 1 is an elevational view of a first form of actuator according to the present invention.
FIG. 2 is an end elevational view of the actuator of FIG. 1.

Referring to the drawing and firstly to FIGS. 1 and 2 there is illustrated an actuator 10 according to a first form of the present invention comprising first and second members 11 and 12 which are in the form of flat plates and which are hinged together along one edge by means of a hinge 13 for pivotal movement about an axis 14 extending generally parallel to their side edges. A further pair of members 15 and 16 which are hinged together by means of a hinge 17 for movement about an axis 18 extending parallel to the axis 14 are also hingedly connected at their opposite ends by respective hinges 19 and 20 to the respective first and second members 11 and 12. The pivotal axes of the hinges 19 and 20 are also parallel to the axes 14 and 13. Suitably the hinges 19 and 20 are secured to the respective first and second members 11 and 12 by means of clamping blocks 21 and bolts 22.

Disposed in the space between the respective pairs of members 11 and 12 and 15 and 16 is a fluid expansible element comprising in this embodiment a length of flat hose which is clamped and sealed at each end by means of the clamping blocks 21. The fluid expansible element 23 also communicates with a hollow connector 24 mounted to the first member 11, the connector 24 communicating with the interior of the element 23.

In use and when it is desired to move the actuator 10 from its position shown in FIG. 1, fluid pressure is applied to the connector 24 as for example derived from a hose connected to a normal mains water supply. Application of pressure to the element 23 will cause expansion thereof and therefore pressure to be applied both to the first pair of members 11 and 12 and to the second pair of members 15 and 16. This will cause the first and second members 11 and 12 to pivot about the axis 14 away from each other and a similar movement of the members 15 and 16 about the hinges 17, 19 and 20 until the latter members are moved into a substantially aligned position where they prevent further outward movement of the members 11 and 12 as shown in dotted outline in FIG. 1. For this purpose the members 15 and 16 are provided with suitable stops which co-act when the members 15 and 16 are in the FIG. 1 dotted outline expanded position to prevent movement of the latter members beyond this position. In one arrangement the cooperative stops may simply comprise the ends 15' and 16' of the respective members 15 and 16 which come into abutment when the members 15 and 16 are aligned.

The stops may be arranged so that the members 15 and 16 move slightly beyond the aligned position, for example a past centre position so that the members 11 and 12 may be locked positively in an open attitude until the members 15 and 16 are released from this position. In other arrangements, the cooperative stops may be secured to the members 15 and 16. It will of course be apparent that the stops may be arranged to limit movement of the members 15 and 16 beyond any desired angular attitude so that for example the members 15 and 16 never reach longitudinal alignment.

When it is desired to collapse the actuator 10 and move it back to its initial position, fluid pressure is removed and the connector 25 connected to drain so that any loads on the members 11 and 12 or 15 and 16 will cause their movement back to the collapsed or folded altitude.

If desired, fluid may be applied to the element 23 through a releasable one-way valve which will prevent escape of fluid from the element 23 such that when the actuator has been expanded it will be locked in that position until fluid can be drained from the element 23. Of course drainage of fluid from the element 23 may be rate controlled, for example by means of a metering valve so that movement of the actuator 10 to its collapsed position can be controlled as desired.

Figure 4:
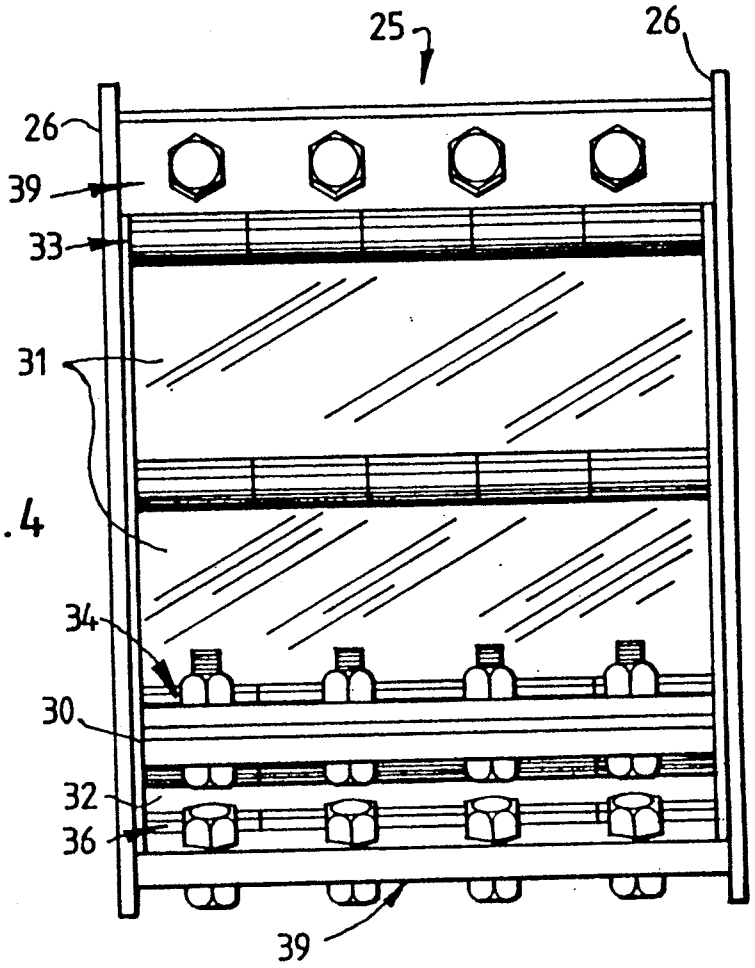
FIG. 4 is an end elevational view of the actuator of FIG. 3.
Figure 3:
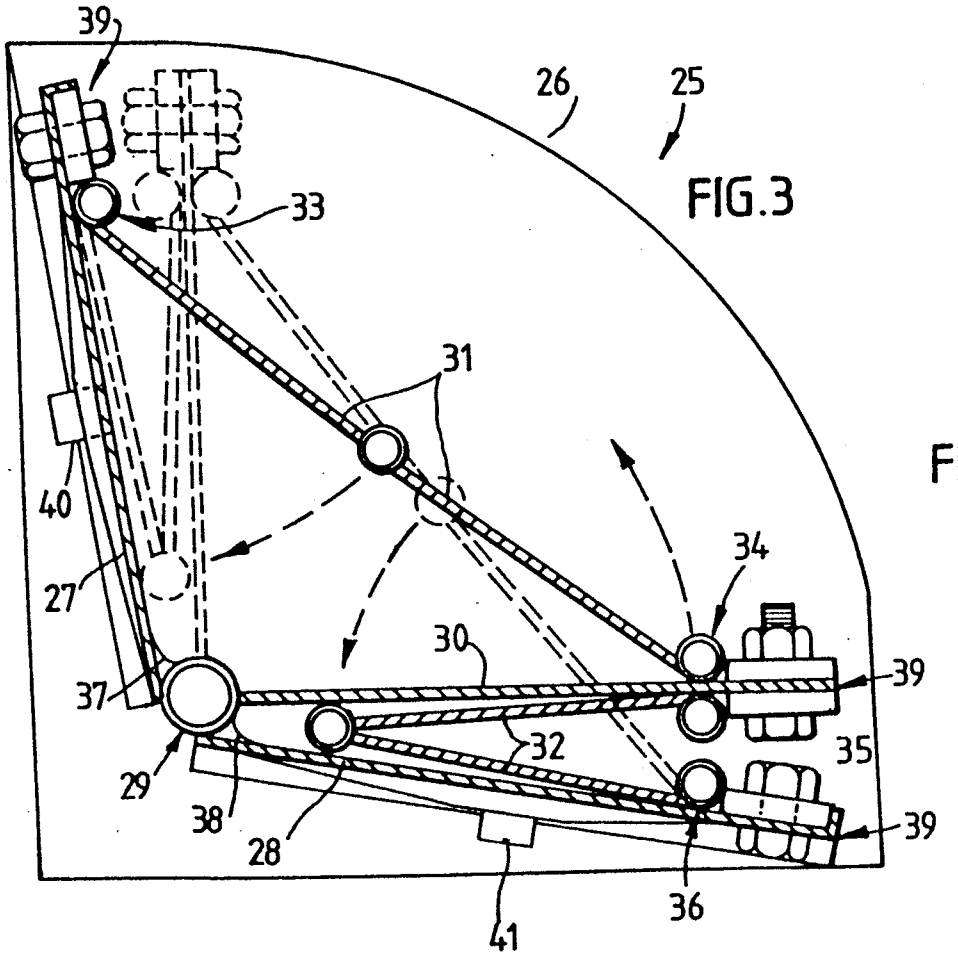
FIG. 3 is an elevational view of a second form of actuator according to the invention.
Figure 5:
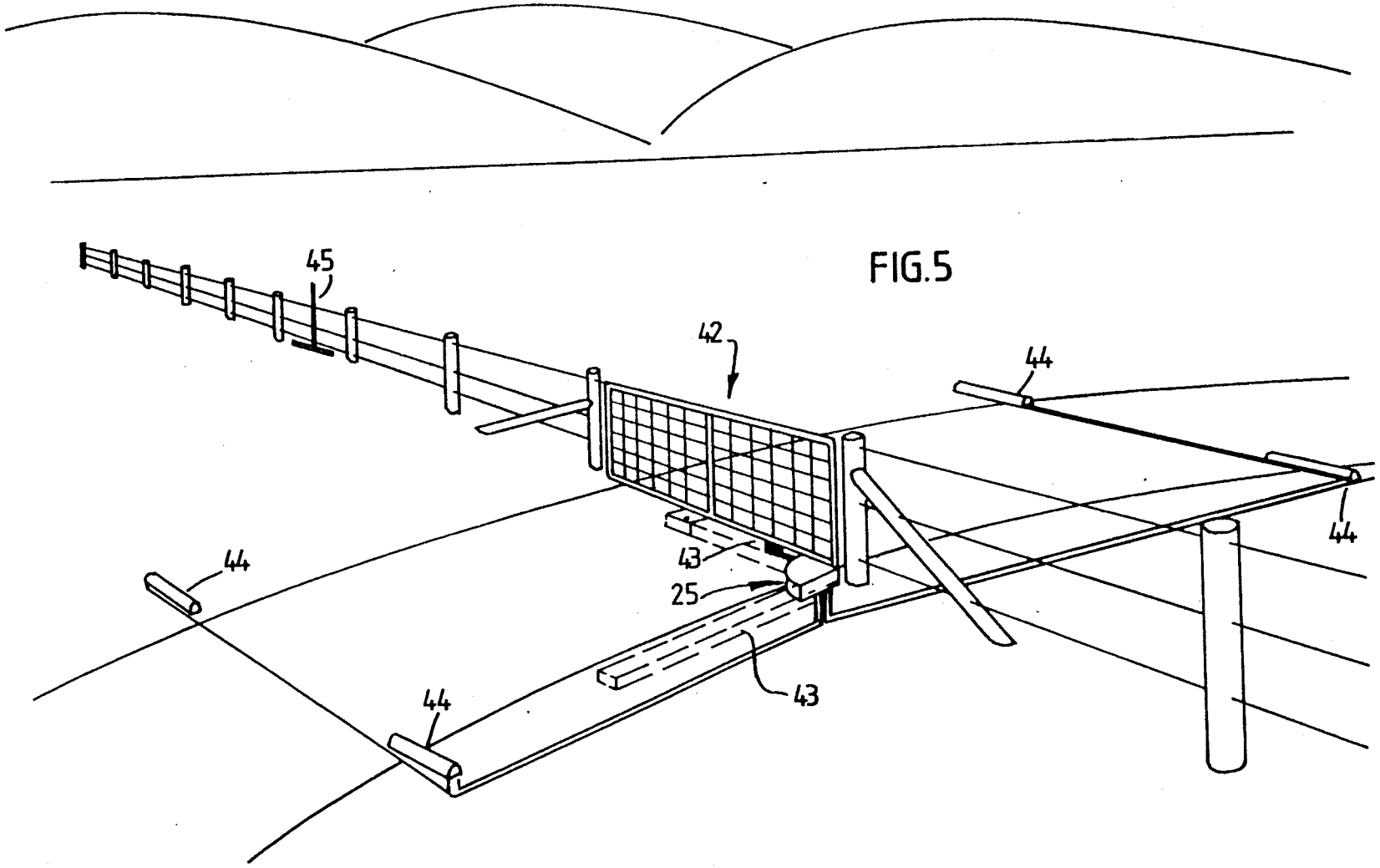
FIG. 5 illustrates a typical application of the actuator of the invention.

Referring now to FIGS. 3 and 4 there is illustrated an alternative form of actuator 25 according to the invention which comprises in substance a pair of actuators 10 of the type shown in FIG. 1 arranged in a back to back relationship. In this embodiment, however, a pair of supporting side plates 26 are provided between which are rigidly secured a pair of fixed angularly disposed members 27 and 28 which meet and support a hinge 29 to which an intermediate member is mounted for pivotal movement about the hinge 29 towards and away from the respective members 27 and 28. Pairs of hingedly interconnected members 31 and 32 corresponding to the members 15 and 16 of the FIG. 1 embodiment are hingedly connected at 33, 34, 35, and 36 to the respective members 27 and 30, and 30 and 28. Again in each case the respective hinge axes are substantially parallel.

Respective fluid expansible elements 37 and 38 are disposed between the members 27, 30 and 31, and 28, 30 and 32. The elements 37 and 38 again are preferably in the form of an expansible section of a flat hose clamped at each end to the respective members by clamping assemblies 39. Inlet/outlet connectors 40 and 41 communicate with the respective expansible elements 37 and 38 and are mounted to the fixed members 27 and 28. As with the previous embodiment, the members 27, 28, 30, 31 and 32 are preferably in the form of flat plates.

In the FIG. 3 attitude shown the element 37 between the members 27, 30 and 31 has been expanded by the application of fluid pressure to its associated inlet/outlet connector 40 whilst the inlet/outlet connector 41 to the other element has been connected to drain. Thus the intermediate member 30 is pivoted to a position adjacent the member 28 with the respective members 31 substantially aligned. The actuator 25 is looked in this position until the pressure or fluid in the element 37 is released. Where it is desired to move the member 30 the connector 40 is connected to drain and fluid pressure applied to the element 38 through the other connector 41. The latter element will thus expand to thereby move the member 30 to the position shown in dotted outline wherein the hingedly interconnected members 32 are aligned and co-act to prevent angular movement of the member 30 beyond this position. The member 30 may of course be moved back to its initial position by releasing pressure of fluid from the element 38 and applying fluid pressure to the element 37.

Preferably application of fluid to the respective elements 37 and 38 is controlled by means of solenoid control valves which may be actuated to apply or release fluid from the elements as desired. Either actuator 10 or 25 may also incorporate a pressure sensing switch associated with the or each fluid expansible element which will respond to provide an alarm if the either movable member is attempted to be moved from its position thereby causing an increase in pressure in the expanded element.

Movement of the members 15 of the actuator 10 or 30 of the actuator 25 may be used for the application of force to any suitable load, either by means of a connection to the moving member or to a part of the hinge which moves with the member. A typical application of the actuator 25 is shown in FIG. 4 applied to the opening and closing of a gate 42. In this arrangement the gate 42 is connected at one side to an extension of the member 30 and one of the side plates 26 of the actuator casing is secured to a support in the ground which may comprise a pair of railway sleepers 43 or a concrete foundation. Respective load sensing elements 44 are arranged on the roadway on either side of the gate with each being responsive to the weight of the vehicle thereon. Thus if a vehicle is driven onto a load sensing element 44, pressure will be switched to the opposite expansible element of the actuator 25 as described above so that the gate 42 is pivoted to an open position. A similar load sensing element 44 provided on the opposite side of the gate 42 will when driven over cause the actuator 25 to move the gate back to its closed position. If desired the actuator may also be operated manually, for example by means of a lever 45 arranged along a fence line.

Whilst the arrangement described above is an example of the application of the actuator according to the invention it is to be considered by no means limiting of the applications available. For example the actuators may be used to apply force and movement to lower and raise vehicles, trailers or platforms or open and close large doors. Many other applications will be readily apparent. Furthermore, whilst it is preferred that the actuating fluid for the actuators is water, any other suitable liquid such as oil may be used as may be any gas.

All variations and modifications to the invention as would be apparent to persons skilled in the art are deemed to fall within the broad scope and ambit of the invention as defined in the appended claims.

I claim:

1. A fluid actuator comprising:

a first planar member;

a second planar member;

means for hingedly interconnecting said first and second planar members for pivotal movement about a first axis;

a third planar member;

a fourth planar member;

means for hingedly interconnecting said third and fourth planar members for pivotal movement about a second axis, said second axis being substantially parallel to said first axis;

means for hingedly interconnecting said first and said third members for pivotal movement about a third axis substantially parallel to said first and second axes; and means for hingedly interconnecting said second and fourth members for pivotal movement about a fourth axis substantially parallel to said first, second and third axes;

said members being movable from a first position wherein said first and third members and second and fourth members respectively are disposed adjacent to each other and said third and fourth members are disposed at an acute angle to each other and located between said first and second members, and a second position wherein said members are moved away from said adjacent position;

a fluid expansible element disposed between said first, second, third and fourth planar members; and means for supplying fluid to said fluid expansible element to as to cause said element to expand and be urged against said members thereby to cause said members to move away from said first position towards said second position.

2. A fluid actuator as claimed in claim 1, wherein said third and fourth members are substantially longitudinally aligned in said second position.

3. A fluid actuator as claimed in claim 1, wherein said fluid expansible element comprises a normally flat hose, said hose being sealed and connected at its opposite ends to said first and second members adjacent said third and fourth axes.

4. A fluid actuator as claimed in claim 3, wherein said hose is folded transversely intermediate its ends in said first position of said members.

5. A fluid actuator as claimed in claim 4, further comprising clamping means for clamping said hose at its opposite ends to said first and second members.

6. An actuating apparatus comprising a pair of fluid actuators of the type defined in claim 1, said actuators being disposed in a back to back relationship, said first and second members of respective said actuators being fixed for movement with each other.

7. An actuating apparatus as claimed in claim 6, wherein said first and second members of the respective said actuators comprise a single member.

8. An actuating apparatus as claimed in claim 7, wherein said second and first members of said respective actuators are fixed against movement relative to each other.

9. An actuating apparatus as claimed in claim 8, wherein said second and first members are disposed between a pair of spaced planar side members and secured thereto so as to be fixed against movement relative to each other.

10. A fluid actuator comprising:

first and second planar members hingedly interconnected to each other for pivotal movement about a first axis;

elongated flexible normally flat tubular element sealed, and secured, at opposite ends to said first and second members respectively at positions spaced from said first axis;

third and fourth planar members hingedly interconnected to each other for pivotal movement about a second axis substantially parallel to said first axis;

means for hingedly interconnecting said first and third members for pivotal movement about a third axis substantially parallel to said first and second axes; and means for hingedly interconnecting said second and fourth members for pivotal movement about a fourth axis substantially parallel to said first, second and third axes;

said first and second members, and said third and fourth members, respectively in a first position being at an acute angle to each other with said first and third members, and second and fourth members adjacent to each other so that said tubular element is located between said members and folded transversely about an axis intermediate its ends; and means for applying fluid pressure to said element to cause said element to expand and act against said members so as to cause said first and third members, and second and fourth members respectively to move relatively about their respective hinge axes away from each other.

11. A fluid actuator as claimed in claim 10, further comprising means for clamping said element at said opposite ends to said first and second members.

12. An actuating apparatus including:

first and second fixed planar members arranged at an angle to each other and converging towards an apex;

a third planar member hingedly mounted adjacent said apex for pivotal movement about a first axis;

fourth and fifth planar members hingedly interconnected for pivotal movement about a second axis substantially parallel to said first axis;

said fourth member being hingedly connected to said first member for pivotal movement about a third axis substantially parallel to said first and second axes; and said fifth member being hingedly connected to said third member for pivotal movement about a fourth axis substantially parallel to said first, second and third axes;

sixth and seventh planar members hingedly interconnected for pivotal movement about a fifth axis substantially parallel to said first, second, third and fourth axes;

said sixth member being hingedly connected to said third member for pivotal movement about a sixth axis substantially parallel to said first, second, third, fourth and fifth axes; and said seventh member being hingedly connected to said second member for pivotal movement about a seventh axis substantially parallel to said first, second, third, fourth, fifth, and sixth axes;

a first fluid expansible element disposed between said first, third, fourth and fifth members; and a second fluid expansible element disposed between said second, third, sixth and seventh members;

said third member being pivotally movable about said first axis between a first position adjacent said first member and a second position adjacent said second member;

said fourth and fifth members in said first position being disposed adjacent said first and third members respectively, and said sixth and seventh members in said first position being substantially longitudinally aligned;

said sixth and seventh members in said second position being disposed adjacent said third and second members respectively and said fourth and fifth members in said second position being substantially longitudinally aligned; and means for supplying fluid to the respective said elements to cause expansion thereof against the respective said members and thereby pivotal movement of said third member between said first and second positions.

13. An actuating apparatus as claimed in claim 12, wherein said first and second fluid expansible elements comprise normally flat hoses sealed at their opposite ends, said first element being secured to said first and third members and said second element being secured to said second and third members.

14. An actuating apparatus as claimed in claim 12, wherein said first and second members are disposed between a pair of spaced planar side members and secured thereto.

15. A gate assembly comprising a pivotal gate member adapted for closing an opening and actuating apparatus as claimed in claim 12, wherein said gate member is coupled to said third planar member so as to be movable therewith to open and close said opening.

* * * * *